US011060265B1

(12) United States Patent
Sadeghini

(10) Patent No.: US 11,060,265 B1
(45) Date of Patent: Jul. 13, 2021

(54) WATER CONSERVATION APPARATUS

(71) Applicant: Antonio G. Sadeghini, Los Angeles, CA (US)

(72) Inventor: Antonio G. Sadeghini, Los Angeles, CA (US)

( * ) Notice: Subject to any disclaimer, the term of this patent is extended or adjusted under 35 U.S.C. 154(b) by 10 days.

(21) Appl. No.: 16/502,912

(22) Filed: Jul. 3, 2019

(51) Int. Cl.
*E03B 1/04* (2006.01)
*A47K 3/28* (2006.01)

(52) U.S. Cl.
CPC ..... *E03B 1/042* (2013.01); *A47K 3/281* (2013.01); *E03B 2001/045* (2013.01)

(58) Field of Classification Search
CPC . E03B 1/042; E03B 1/048; E03B 1/04; A47K 3/281
USPC ..... 4/597
See application file for complete search history.

(56) References Cited

U.S. PATENT DOCUMENTS 1,261,363 A * 4/1918 Crist ..... F16M 11/00 248/165
5,165,456 A * 11/1992 Woolman ..... E03B 1/048 141/98
5,557,812 A * 9/1996 Sayant ..... E03D 5/003 4/665
5,564,462 A 10/1996 Storch
7,802,327 B1 * 9/2010 Moceri ..... A63H 33/3038 4/625
2013/0061944 A1 * 3/2013 Tarantino ..... E03B 1/048 137/101.27
2019/0161974 A1 5/2019 Parra
2020/0318332 A1 * 10/2020 Christian ..... A47K 3/281

FOREIGN PATENT DOCUMENTS

CN 2547777 Y 4/2003
CN 201129870 Y 10/2008
ES 2336526 A1 4/2010

OTHER PUBLICATIONS www.mcmaster.com Hose to Pipe Elbows. McMaster-Carr Oct. 10, 2018 (Year: 2018).*

* cited by examiner

*Primary Examiner* — Christine J Skubinna
(74) *Attorney, Agent, or Firm* — Fitch, Even, Tabin & Flannery LLP

(57) ABSTRACT

In one aspect, a water conservation apparatus is provided that includes a diverter having an inlet for being connected to a water supply, a primary outlet, and a secondary outlet. The apparatus includes an elongate water storage tank and a supply conduit configured to connect the secondary outlet of the diverter to the water storage tank. The elongate water storage tank has a height and a width perpendicular to the height that is less than the height so that the water from the secondary outlet of the diverter forms a column within the tank. The apparatus further includes a tap having an outlet and a valve, the valve having a closed position that inhibits water flow from the water tank to the outlet and an open position that permits water to be driven out of the outlet by the column of water in the tank.

20 Claims, 12 Drawing Sheets

WATER CONSERVATION APPARATUS

FIELD

This disclosure relates to residential water conservation and, more specifically, to an apparatus for storing wasted water for later use.

BACKGROUND

To get hot water from a faucet or a shower in a residence, a common approach is to turn the hot water on and let the water run until the water gets to the desired temperature. The delay in getting hot water at the faucet or showerhead is due to the standing water in the supply pipes that must be discharged before hot water from a hot water tank or other heater arrives at the faucet or showerhead. The water discharged while waiting for the water to heat up constitutes a significant volume of wasted water. For example, the wasted water produced by a shower may be in the range of 1.5 to 3 gallons of water each time a person takes a shower. This volume of wasted water is significant, considering that millions of people in the United States take showers or run hot water at a faucet everyday.

SUMMARY

In accordance with one aspect of the present disclosure, a water conservation apparatus is provided that includes a diverter having an inlet for being connected to a water supply, a primary outlet, and a secondary outlet. The apparatus includes a supply conduit configured to connect to the secondary outlet of the diverter and an elongate water storage tank configured to connect to the supply conduit. The elongate water storage tank has a height extending between upper and lower end portions of the tank and a width perpendicular to the height that is less than the height so that the water from the secondary outlet of the diverter forms a column within the tank. The apparatus further includes a tap having an outlet and a valve, the valve having a closed position that inhibits water flow from the water tank to the outlet and an open position that permits water to be driven out of the outlet by the column of water in the tank. The elongate configuration of the water storage tank creates a compact column of water and maximizes the head of the water within the tank. By maximizing the head of the water in the water storage tank, the water pressure may be maximized at the tap so that the water in the tank discharged from the tap may be delivered at a flow rate similar to the flow rate from a nearby faucet. Further, the elongate configuration of the water storage tank may provide a compact footprint of the tank against a wall or on a countertop to make installation easier and provide an aesthetically pleasing appearance of the water tank.

In accordance with another aspect, a water conservation apparatus is provided that includes a diverter having an inlet, a primary outlet, and a secondary outlet. The water conservation apparatus includes a water tank, a supply conduit configured to connect the water tank to the secondary outlet of the diverter, and a tap associated with a lower end portion of the water tank. The water conservation apparatus further includes an overflow conduit configured to connect to an upper end portion of the water tank and permit excess water to flow out of the water tank. The overflow conduit permits excess water to be discharged, such as into a shower or a sink drain, upon the water tank reaching a predetermined fill volume. For example, the water conservation apparatus may be installed to conserve water from a shower. While waiting for the shower water to heat up, the user may receive a phone call and forget that the shower water is running. Once the water tank has filled, the continued running of the shower water causes water to exit the water tank via the overflow conduit. The overflow conduit permits a user to know that the water tank will fill to the predetermined fill volume and discharge water in excess of the predetermined fill volume rather than overflowing.

A water conservation kit is also provided that includes a water storage tank and a diverter in the water storage tank. The diverter has an inlet configured to be connected to a water source, a primary outlet, and a secondary outlet. The water conservation kit also includes a supply conduit in the water storage tank configured to be connected to the secondary outlet of the diverter and a tap in the water storage tank. By using the water storage tank as a container for the components of the water conservation kit, no additional exterior packaging may be required. Further, the water conservation kit may include all of the components needed to install a water conservation apparatus rather than requiring a user to locate the individual components in a various departments of a store, such as a home improvement store, which may be difficult or intimidating for some users. The components of the water conservation kit may be readily removed from an interior of the water conservation tank by removing a lid of the tank and withdrawing the components as needed to install the water conservation apparatus.

DETAILED DESCRIPTION

Figure 1:
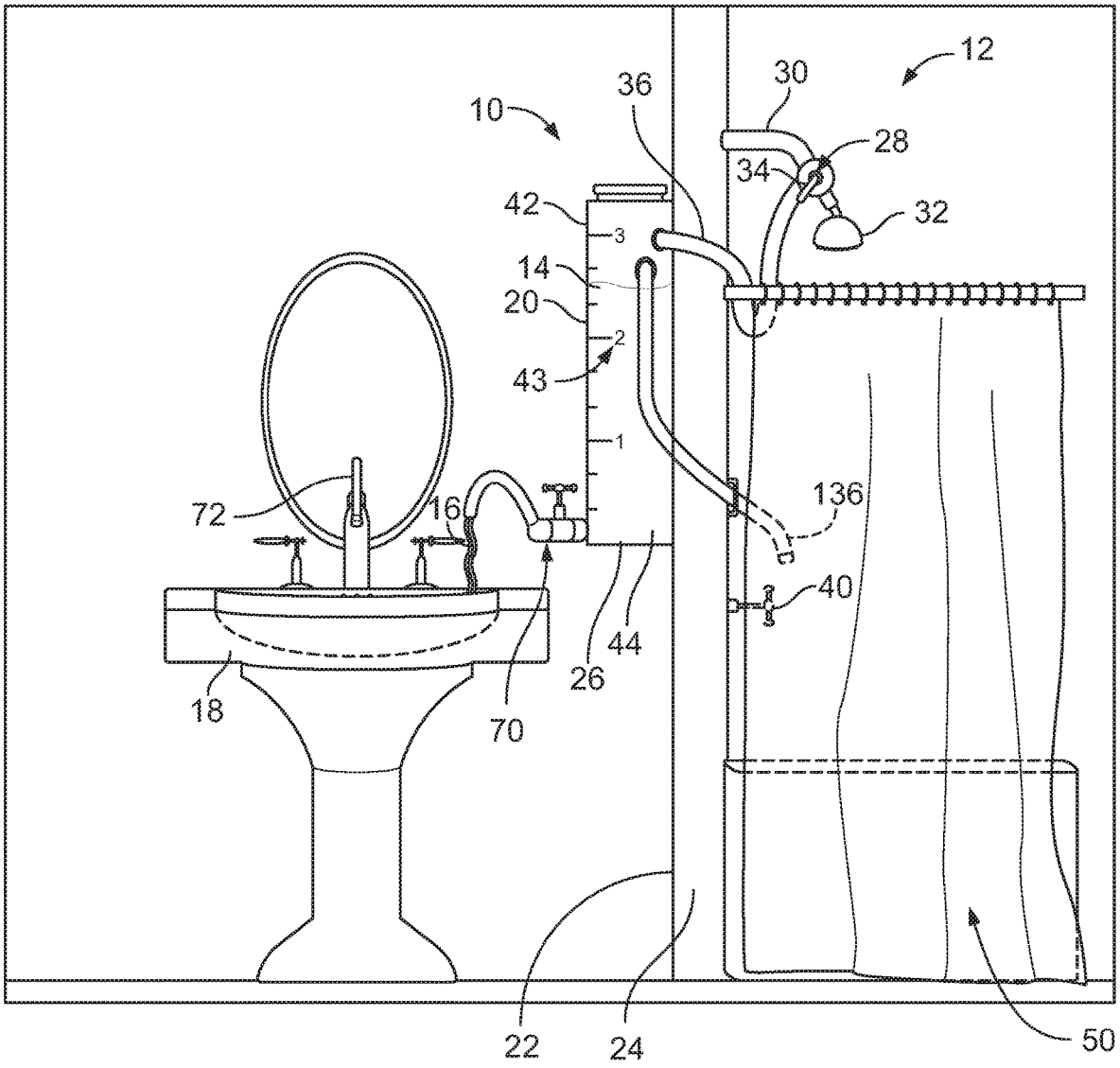
FIG. 1 is an elevational view of a water conservation apparatus installed in a bathroom to capture unused water from a shower for subsequent use at a sink of the bathroom.

With reference to FIG. 1, a water conservation apparatus 10 is provided that is configured to capture unused water 14 from a shower 12, store the water 14, and selectively discharge conserved water 16 into a sink 18 as desired by a user. The water conservation apparatus 10 includes a tank 20 mounted to a surface 22 of a wall 24 or positioned so that a base 26 of the tank 20 is supported by the sink 18. The water conservation apparatus 10 includes a diverter, such as a diverter valve assembly 28, that connects to a shower arm 30 of the shower 12 and a showerhead 32 of the shower 12 so that the diverter valve assembly 28 is located between the shower arm 30 and the showerhead 32. The diverter valve assembly 28 includes a user interface, such as a handle 34, that may be moved from a first position wherein the diverter valve assembly 28 permits water to flow from the shower arm 30 to the showerhead 32 to a second position wherein water from the shower arm 30 is diverted into a reservoir supply conduit 36. Thus, when a user turns on the water to the shower 12 using a knob 40 and the lever 34 is in the second position, the water will flow from the shower arm 30 into the tank supply conduit 36 and into the tank 20. The tank 20 stores the unused water 14 for subsequent use, such as for drinking or rinsing the user's toothbrush.

The tank 20 may include a transparent portion 42 having an indicium 43 that permits a user to visually identify the volume of water 14 stored in the tank 20. In one embodiment, the indicium 43 is a scale with numerical markings on the side such as indicating the gallons of water stored in the tank 20. In another embodiment, the indicium 43 may include simply an indication such as the word "full" next to a level line. The indicium 43 permits a user to visually identify when a predetermined amount of water 14 has been received from the shower arm 30 such that the water now present in the shower arm 30 is of an adequate temperature. For example, homes in a warmer climate such as Los Angeles, Calif., may usually require the tank 20 to receive two gallons of water from the shower arm 30 before the water in the shower arm 30 is considered hot. The indicium 43 makes it easy for a user to visually identify when the water is hot, by simply observing that the tank 20 has received the predetermined volume of water. At this point, the user may turn the knob 34 to direct the water from the shower arm 30 to the showerhead 32 and utilize the shower 50.

Figure 4:
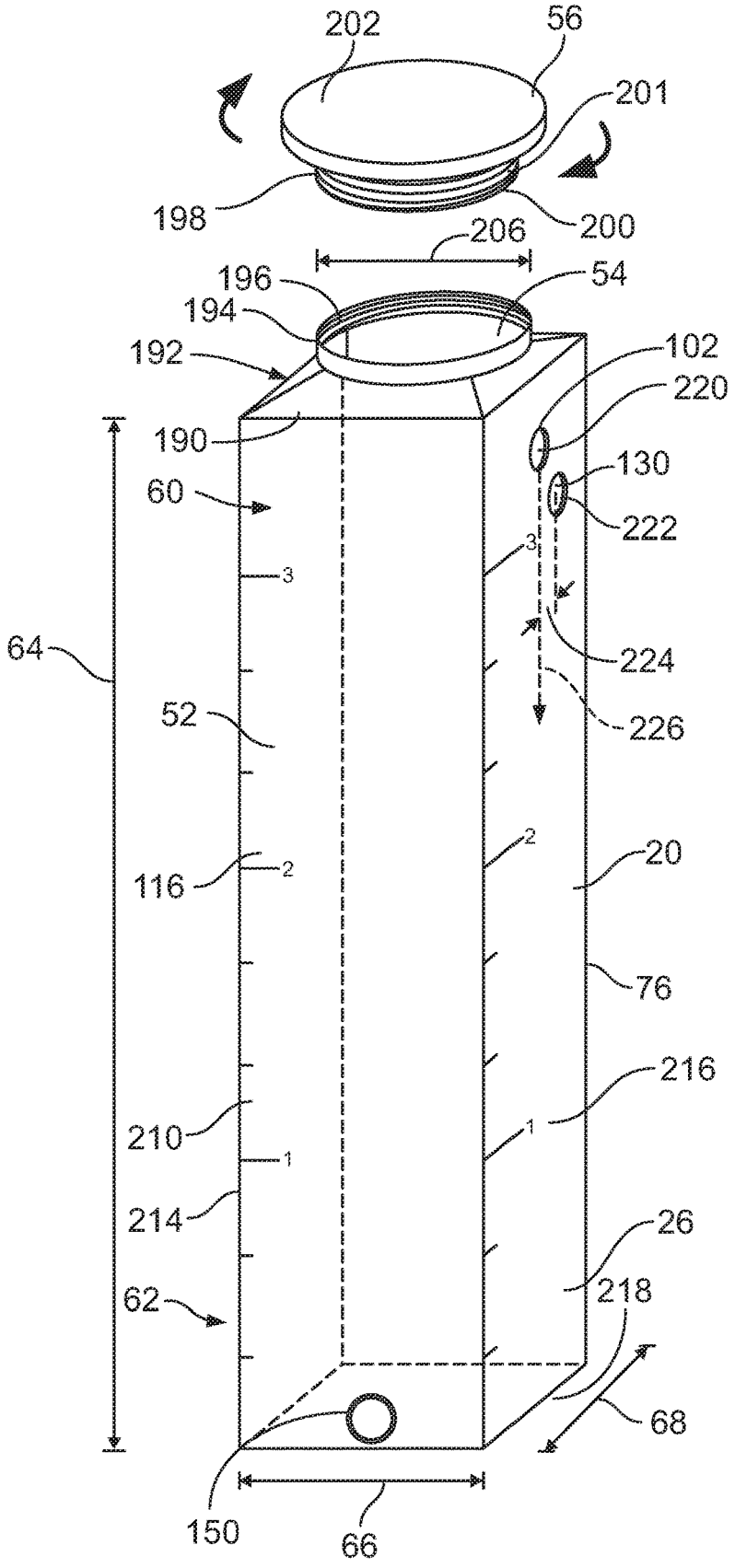
FIG. 4 is a perspective view of the tank of FIG. 2 showing a scale on the side of the tank to indicate the volume of water retained in the tank.
Figure 5:
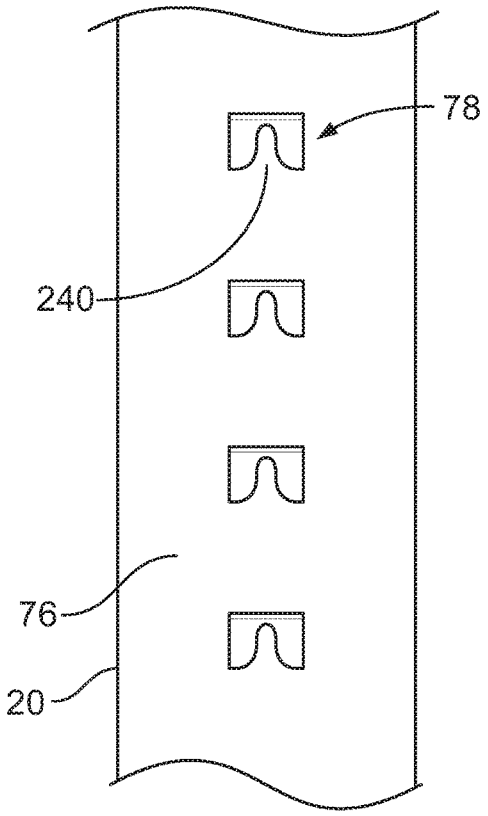
FIG. 5 is a rear view of a portion of the tank of FIG. 4 showing mounting portions of the tank arranged in a line.

With reference to FIG. 4, the tank 20 may include a body 52 having an opening 54 and a lid 56 that may be connected to the body 52 to close the opening 54. The body 52 has an upper end portion 60, a lower end portion 62, and a height 64 extending therebetween. The height 64 of the body may be greater than a width 66 of the body 52 as well as a depth 68 of the body 52. The elongate configuration of the tank 20 creates a compact column of water and maximizes the head of the water 14 within the tank 20. By maximizing the head of the water 14 in the tank 20, the water pressure is maximized at a tap 70 (see FIG. 1) such that the conserved water 16 discharged from the tap 70 may be delivered at a flow rate similar to the flow rate from the nearby faucet 72. Further, the elongate configuration of the tank 20 provides a compact footprint of the tank 20 against the wall 24 or on the sink 18 to make installation easier. With reference to FIG. 5, the tank 20 has a rear wall 76 with one or more mounting portions 78, such as four mounting portions 78 arranged vertically. The vertical arrangement of the mounting portions 78 permits the mounting portions to all be connected to a single support member in the residence, such as a single stud 80 (see FIG. 7). This inline arrangement of the mounting portions 78 provides a stable connection between the tank 20 and the wall 24 by focusing the loading from the tank 20 onto a single support structure.

Figure 2:
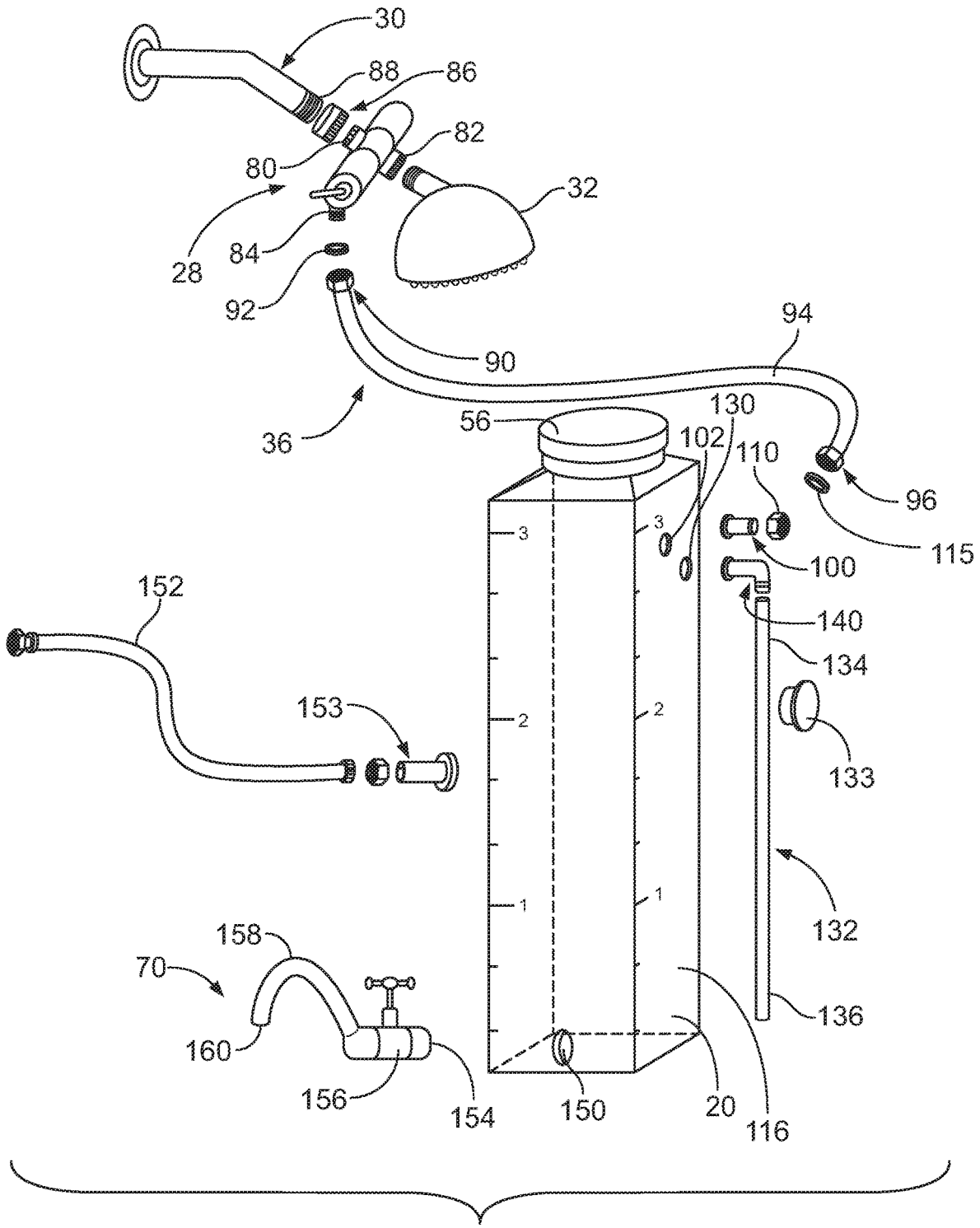
FIG. 2 is an exploded view of the water conservation apparatus of FIG. 1 showing a diverter of the apparatus, a conduit connecting the diverter and a tank, and a tap for selectively discharging water from the tank.

With reference to FIG. 2, the diverter valve assembly 28 includes an inlet, such as an upstream water source connector 80, and a primary outlet, such as a showerhead connector 82, and a secondary outlet, such as a reservoir connector 84. In one embodiment, the connector 80 has a male threaded connection that engages a fitting, such as a nut 86, to connect to threads 88 of the shower arm 30. The shower connector 82 may include male threads to connect the showerhead 32 and the reservoir connector 84 may include a male thread to connect to a tube nut 90 of the reservoir supply conduit 36. One or more washers 92 may be connected between the connectors 80, 82, 84 and their respective components to provide a watertight seal. In one embodiment, the reservoir supply conduit 36 includes a flexible tube 94 connecting the tube nut 90 to a tube nut 96. The flexible tube 94 may be made of a plastic material, a rubber material, or other flexible material. The reservoir supply conduit 36 may include a sleeve extending along the tube 94 to provide a desired appearance, such as a metallic, jointed sleeve.

The tube nut 96 connects to a connector, such as a threaded nipple 100, associated with an inlet opening 102 of the tank 20. With reference to FIG. 8, the threaded nipple 100 includes a shank 101 that is advanced from an interior of the tank 20 through an inlet opening 102 (see FIG. 2), and outward from the tank 20. The threaded nipple 100 also includes a head 104 with a washer 106 that are positioned inside of the tank 20. The washer 106 bears against an inner surface 108 (see FIG. 7) of the tank 20. The connector further includes a nut 110 that is engaged with threads 112 of the threaded nipple 100. The nut 110 has a flange 114 that clamps a side wall 116 (see FIG. 2) between the flange 114 and the head 104, washer 106 assembly. The threaded nipple 100 includes a through opening 120 that permits fluid flow from the reservoir supply conduit 36 into the tank 20.

Figure 15:
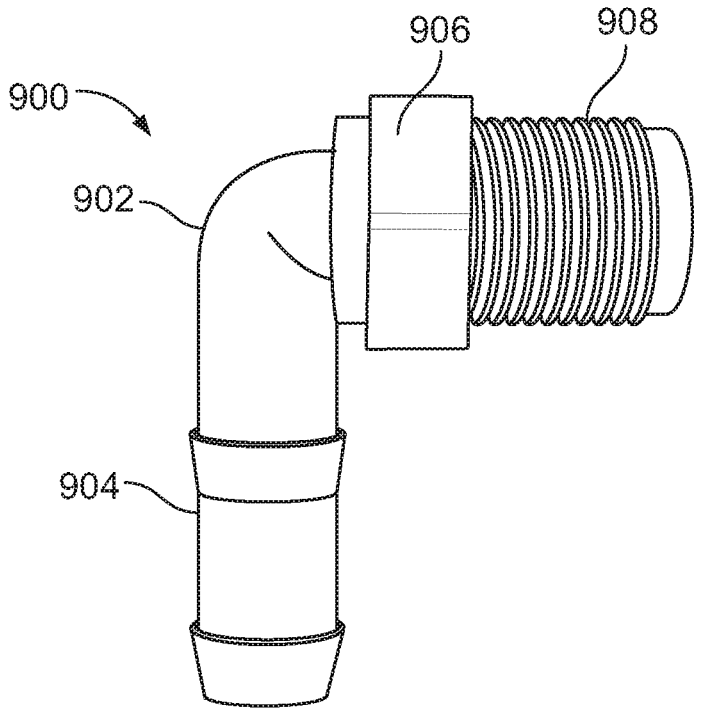
FIG. 15 is a plan view of a fitting that may be used to connect the conduit from the diverter to the tank of FIG. 1.

In one embodiment, a threaded elbow 900 (see FIG. 15) may be provided to redirect the water 14 downward toward the base 26 of the tank 20 instead of the threaded nipple 100. The threaded elbow 900 includes an elbow portion 902 that redirects water flow, such as ninety degrees, and an outlet portion 904. The threaded elbow 900 further includes a gripping portion 906, such flat sides for engaging a wrench, e.g., six flat sides, and a threaded portion 908. To install the threaded elbow 900 on the tank 20, a washer having an o-ring seal is positioned on the threaded portion 908 and the threaded portion 908 is advanced from the inside of the tank 20, through the opening 102, and outward from tank 20. A nut is tightened onto the threaded portion 908 so that the side wall 116 of the tank 20 is clamped between the washer/o-ring seal and the nut and the o-ring seal forms a water tight seal around the opening 102. With the threaded elbow 900 installed on the tank 20, the elbow, outlet, and gripping portions 902, 904, and 906 are inside of the tank 20.

Regarding FIG. 2, the tank 20 may have a sealed configuration so that once the tank 20 is filled, the water can no longer fill the tank 20. The tank 20 remains full, the water pressure in the tank 20 roughly equals the water pressure in the residence, and the water is effectively stored until a user opens the tap 70. In this approach, the tank 20 has an overflow outlet opening 130 and a cap 133 closes the overflow outlet opening 130.

In another approach, the water conservation apparatus 10 permits water to drain from the tank 20 once the tank 20 has filled. In this approach, the water conservation apparatus 10 includes an overflow conduit 132 (see FIG. 2) having a first end portion 134 connected to the tank 20 by a connector, such as an elbow 140, and a second end portion 136 that is positioned to discharge excess water. The second end portion 136 may be positioned to discharge into the shower 50 as shown in FIG. 1. In another approach, the second end portion 136 is positioned to discharge the excess water into the sink 18. The elbow 140 may have a flange, washer, and nut to be securely connected to the tank 20 in a manner similar to the threaded nipple 100 as discussed above with respect to FIG. 8.

With reference to FIG. 2, the tank 20 includes a reservoir outlet opening 150 and the tap 70 may be connected directly to the tank 20 at the reservoir outlet opening 150 or may be connected indirectly via an outlet conduit 152. When the tap 70 is connected directly to the tank 20, the tap 70 has a connector 154 that may be engaged with threads of the tank 20 extending about the reservoir outlet opening 150. The tap 70 includes a valve 156 and a faucet portion 158 that extends to an opening 160. The faucet portion 158 may have a decreasing internal cross-sectional area to increase the velocity of the water before it is discharged from the opening 160.

Figure 3:
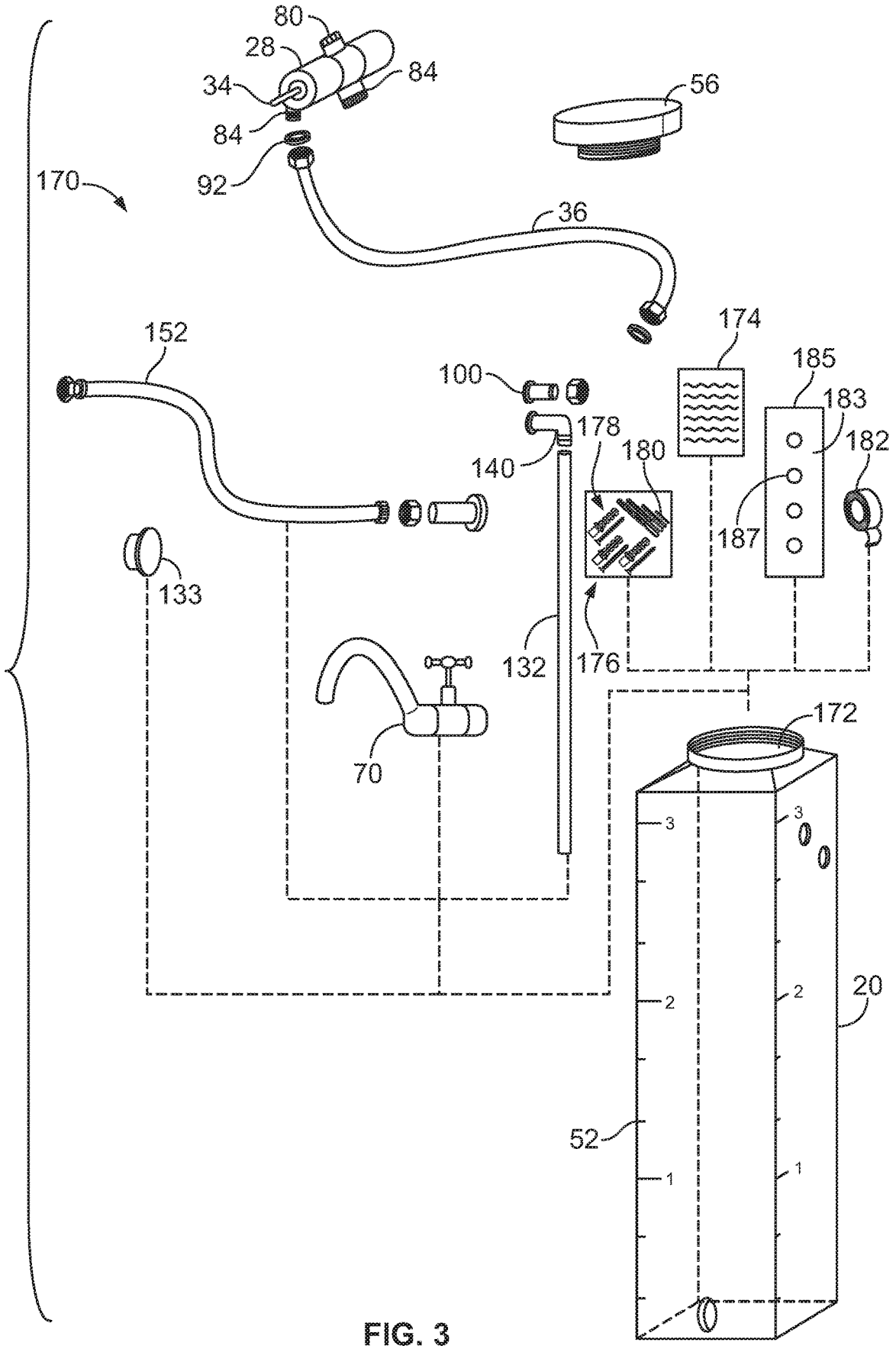
FIG. 3 is an exploded view of the water conservation apparatus of FIG. 2 showing how the components of the apparatus may be packaged as a kit within the tank for transit and sale.

With reference to FIG. 3, the water conservation apparatus 10 may be provided as a kit 170 with the components of the water conservation apparatus 10 being provided in the tank 20. By using the tank 20 as a container for the components of the water conservation apparatus 10, no additional exterior packaging may be required. Further, the components of the water conservation apparatus 10 may be readily removed from an interior 172 of the tank 20 by removing the lid 56 and withdrawing the components as needed to install the water conservation apparatus 10. The kit 170 may include instructions 174 that may be provided as, for example, one or more pieces of paper, a CD-ROM, a website address, and/or a QR code for directing a user to a website so that they may download instructions in electronic form (e.g., an HTML webpage and/or a portable document format (PDF) file). The instructions 174 are received in the interior 172. In another embodiment, the instructions 174 may be provided on exterior of the tank 20, such as a website address or a QR code to direct a user's electronic device to a source for instructions. The kit 170 may include a container, such as a bag 176 that contains one or more anchors such as screws 178. The anchors may include bolts, nails, or multicomponent anchors, such as an expandable member that is driven into an opening in a material and an actuator member that is operated to expand the expandable member and lock the expandable member to the material. The kit 170 may also include a drill bit 180 in the bag 176 or another container as well as nylon tape 182. The nylon tape 182 may be used, for example, to form a watertight seal between the connector 154 of the tap 70 and the reservoir outlet opening 150 of the tank 20.

With reference to FIG. 4, the tank 20 may have a transparent portion or, in another approach, the entire body 52, may be made from a transparent material. The body 52 may have a unitary, one-piece construction. In one embodiment, the body 52 is blow-molded using a transparent material, such as an acrylic material. The openings 102, 130, 150 may be molded into the body 52 or subsequently formed, such as by milling or a drill. The upper end portion 60 of the body 52 includes a tapered section 190 connecting a neck 192 of the body 52 to the side walls 116. The neck 192 includes a rim 194 extending about the opening 54. The neck 192 may include female threads 196 that may engage male threads 198 of a connecting portion 200 of the lid 56. The lid 56 may include a seal, such as an O-ring 200, on the connecting portion 200 and/or on an underside of a gripping portion 202 of the lid 56. The O-ring 200 may seal with a radially inner surface of the neck 92 and/or an upper edge of the rim 194, in some examples. The O-ring 200 is configured to provide a water-tight connection between the lid 56 and the body 52, and resist leakage from the tank 20, in the event that the user utilizes the cap 133 to close the overflow outlet opening 130 rather than the overflow conduit 132 and the connector 140. The opening 54 may have a diameter 206 in the range of, for example, approximately three inches to approximately six inches, such as five inches. Further, the openings 103, 130, 150 may have the same or different diameters. The diameters of the openings 103, 130, 150 may be in the range of approximately 0.25 inches to approximately 1 inch, such as approximately 0.5 inches.

In FIG. 4, the body 52 has a rectangular cross-section taken perpendicular to the height 64. The side walls 116 of the body 52 include a front wall 210, a rear wall 76, and side walls 214, 216 extending therebetween. In another embodiment, the tank 20 has a circular cross-section taken perpendicular to the height 64 and the side wall 116 includes a single cylindrical side wall 116. The body 52 further includes a bottom wall 218 opposite the opening 54 and the side wall 116 extends upwardly from the bottom wall 218. Because the width and depth 66, 68 are less than the height 64, such as less than one half or one quarter of the height 64, the bottom wall 218 has a small footprint on a surface of the countertop or other structure if the tank 20 is not wall-mounted. Further, the elongate tank 20 produces a column of water 14 in the tank 20 to maximize the head at the tap 70 and generate water pressure similar to the faucet 72.

With reference to FIG. 4, the inlet 102 has a center 220 and the overflow outlet opening 130 has a center 222 that are offset by a distance 224. The offset 224 is along the side wall 216 generally in a direction transverse to the height 64, such as laterally. The offset distance 224 permits water that travels into the tank 20 from the reservoir supply conduit 36 to travel along a path 226 along the inner surface 108 of the side wall 216 without entering the overflow outlet opening 130. Thus, the water fills the tank 20 rather than exiting via the overflow conduit 132.

Figure 6:
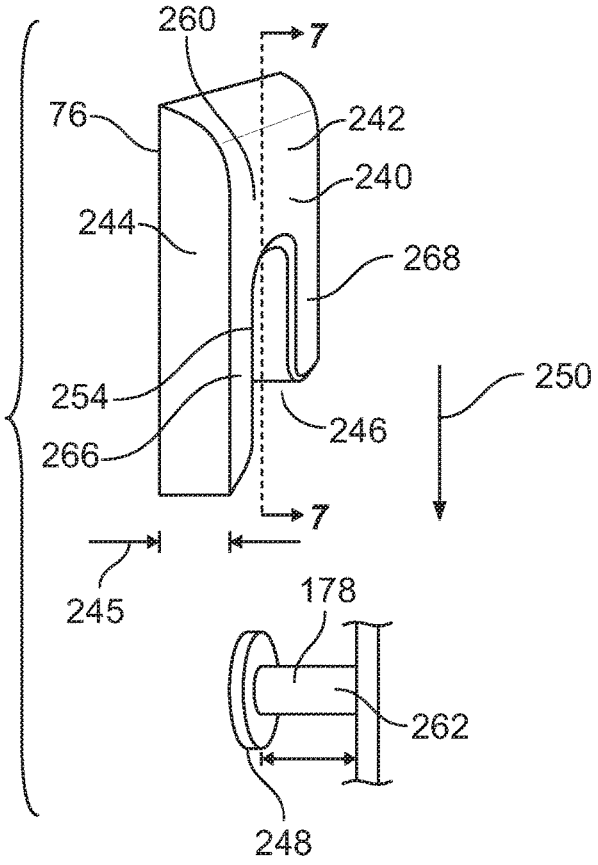
FIG. 6 is a perspective view of one of the mounting portions of FIG. 5 showing a pocket for receiving a head of a screw.
Figure 7:
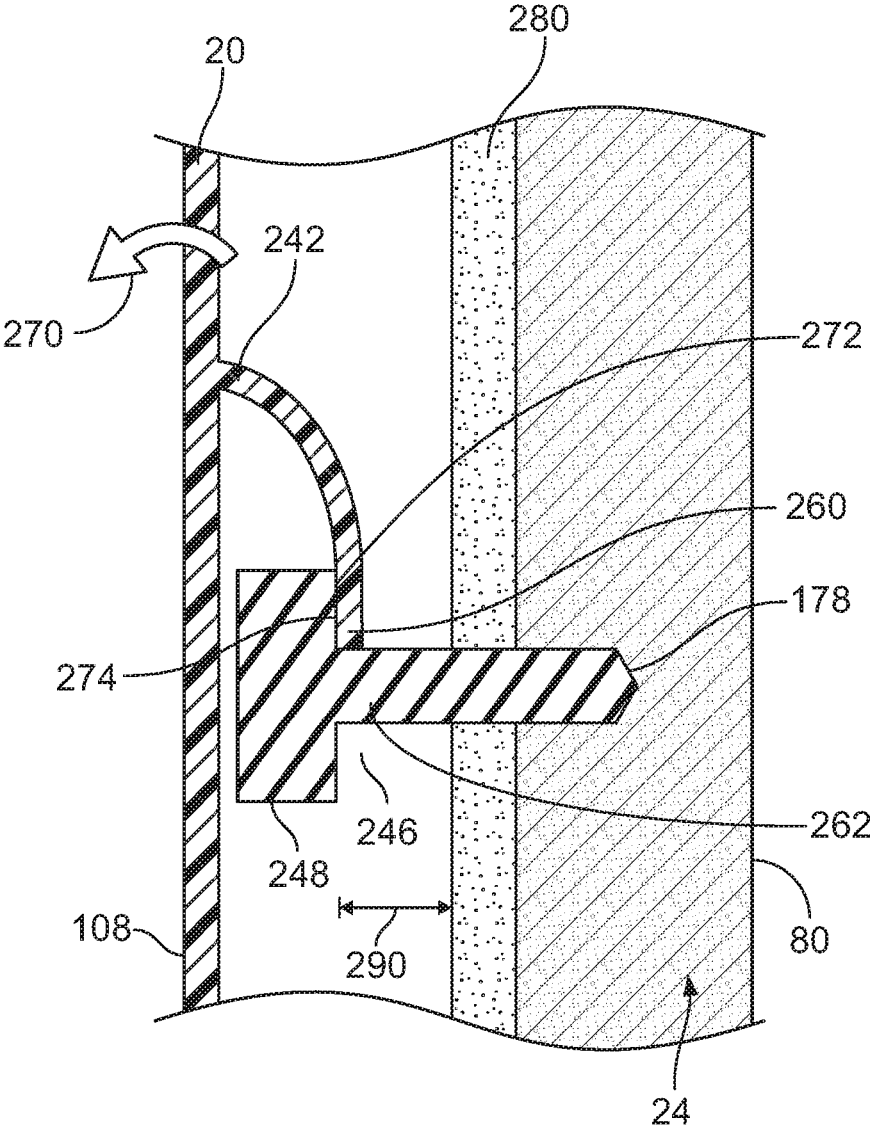
FIG. 7 is a cross-sectional view taken across line 7-7 in FIG. 6 showing an outer wall of the pocket supported on a shank of the screw.
Figure 8:
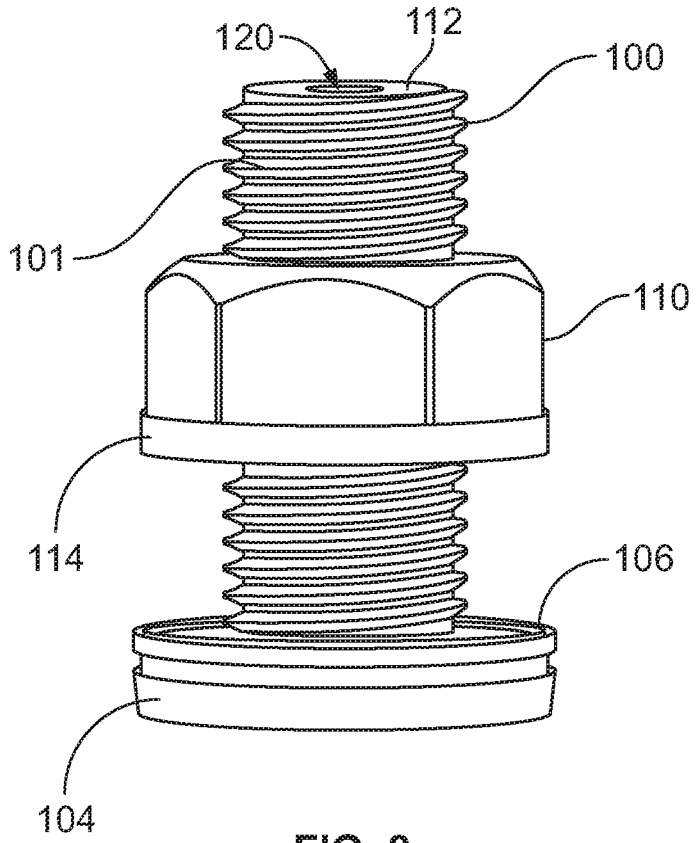
FIG. 8 is an elevational view of an assembly of a threaded nipple, a nut, and a washer that may be used to connect conduits of the water conservation apparatus to the tank.

With reference to FIGS. 5-7, the one or more mounting portions 78 permit the tank 20 to be readily mounted to the wall 24. Further, the mounting portion 78 resist the tank 20 unintentionally disengaging from the wall 24, such as during an earthquake. More specifically and with reference to FIG. 5, the mounting portion 78 may include one, two, or more, such as four, pockets 240. Each pocket 240 may be formed integrally with rear wall 76 so that the rear wall 76 and pockets 240 have a unitary one-piece construction. This provides a rigid mounting point for connecting the tank 20 to the screws 178.

Each pocket 240 includes a pocket outer wall 242 and a pair of opposite side walls 244. The side walls 244 position the outer wall 242 a distance 245 from the rear wall 76, the distance 245 being greater than a thickness of a head 248 of one of the screws 178 to permit the pocket 240 to receive the screw head 248 at least partially therein. The pocket outer wall 242 defines an opening 246 for receiving the screw head 248 as the pocket 240 is moved downward in direction 250 toward the screw 178. In this manner, the tank 20 may be readily positioned onto the screws 178 by simply aligning the pockets 240 with the screws 178 and lowering the tank 20 until the pockets 240 receive the heads 248 of the screws 178.

With reference to FIGS. 6 and 7, pocket outer wall 242 includes an edge 254 extending about the opening 246. The pocket outer wall 242 further includes a support portion 260 that rests on a shank 262 of the screw 178. The contact between the support portion 260 and the shank 262 at each of the mounting portions 78 supports the weight of the tank 20 and the water 14 therein. The pocket outer wall 242 further includes flange portions 266, 268 that extend along opposite sides of the opening 246. The flange portions 266, 268 may contact the shank 262 and limit lateral movement of the pocket 240 relative to the screw 178. With reference to FIG. 7, the weight of the water 14 and the tank 20 may tend to pull the tank 20 away from the wall 24 generally in direction 270. This presses a surface 272 of the pocket outer wall 242 against an underside surface 274 of the screw head 248. This further strengthens the rigidity of the connection between the tank 20 and the wall 24.

With reference to FIG. 7, the wall 24 may include a dry wall sheet 280 and the stud 80. The screw 178 may be driven into the stud 80 as shown in FIG. 7. Further, because of the vertical alignment of the pockets 240, all of the associated screws 178 will also be engaged with the same stud 80. Not only does the tank 20 have a narrow footprint on the wall 24, but the serial connection of the mounting portions 78 to the stud 80 provides a rigid construct of the tank 20 and stud 80 to resist loading, such as during an earthquake. Further, earthquakes generally do not move residences in an up and down movement. Rather, earthquakes generate more of a rolling movement. The tank 20, by contrast, is lifted vertically upward to remove the pockets 240 from their positions on the screws 178. This reduces the risk of the tank 20 unintentionally disengaging from the screws 178 during an earthquake.

With reference to FIG. 7, the screws 178 are preferably secured to the wall 24 so that the head 248 is positioned outward a distance 290, such as one half inch, to position the head 248 to be received in the pocket 240 and the shank 262 to receive the support portion 260 of the pocket outer wall 242.

Figure 9:
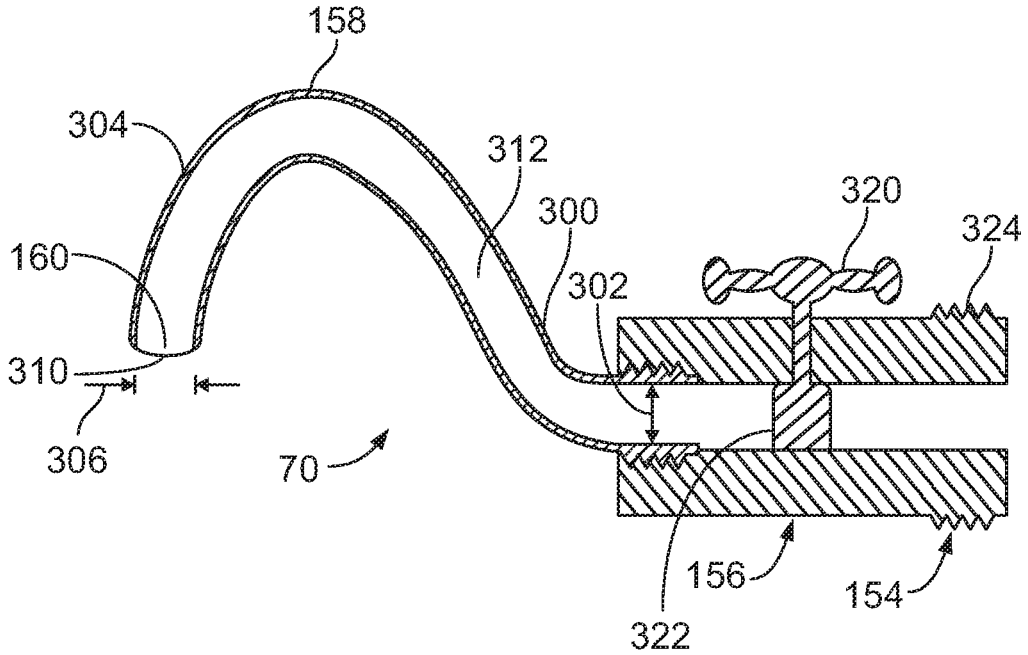
FIG. 9 is a cross-sectional view of the tap of FIG. 2 showing a flow path that decreases in width as the flow path extends from an inlet end of the tap to an outlet end of the tap.

With reference to FIG. 9, the tap 160 includes the faucet portion 158, the valve 156, and the connector 154. The faucet portion 158 includes an inlet portion 300 having a first internal distance 302 and an outlet portion 304 having a second internal distance 306. In one embodiment, the distances 302, 306 are the inner diameter of the faucet portion 158 at the inlet portion 300 and the outlet portion 304. The distance 302 is greater than the distance 306 to increase the velocity of the water flow from the faucet portion 158. This gives the conserved water 16 a similar appearance to the water that would be discharged from the faucet 72. In one embodiment, the distance 306 is less than three quarters, less than one half, or less than one quarter of the distance 302. The faucet portion 158 may also include a screen 310 to break up the flow of water within the flow path 312 of the tap 70. The valve 156 includes a knob 320 that may be used to operate a valve member 322 for selectively opening and closing the flow path 312. In one embodiment, the valve 156 is a ball-type valve and the valve member 322 is a ball member. The connector 154 may include male threads 324 that engage female threads of the reservoir outlet opening 150. In one embodiment, the tap 70 may be in the form of a conventional faucet and the outlet conduit 152 may include copper or plastic tubing connecting the tank 20 to the faucet.

Figure 10:
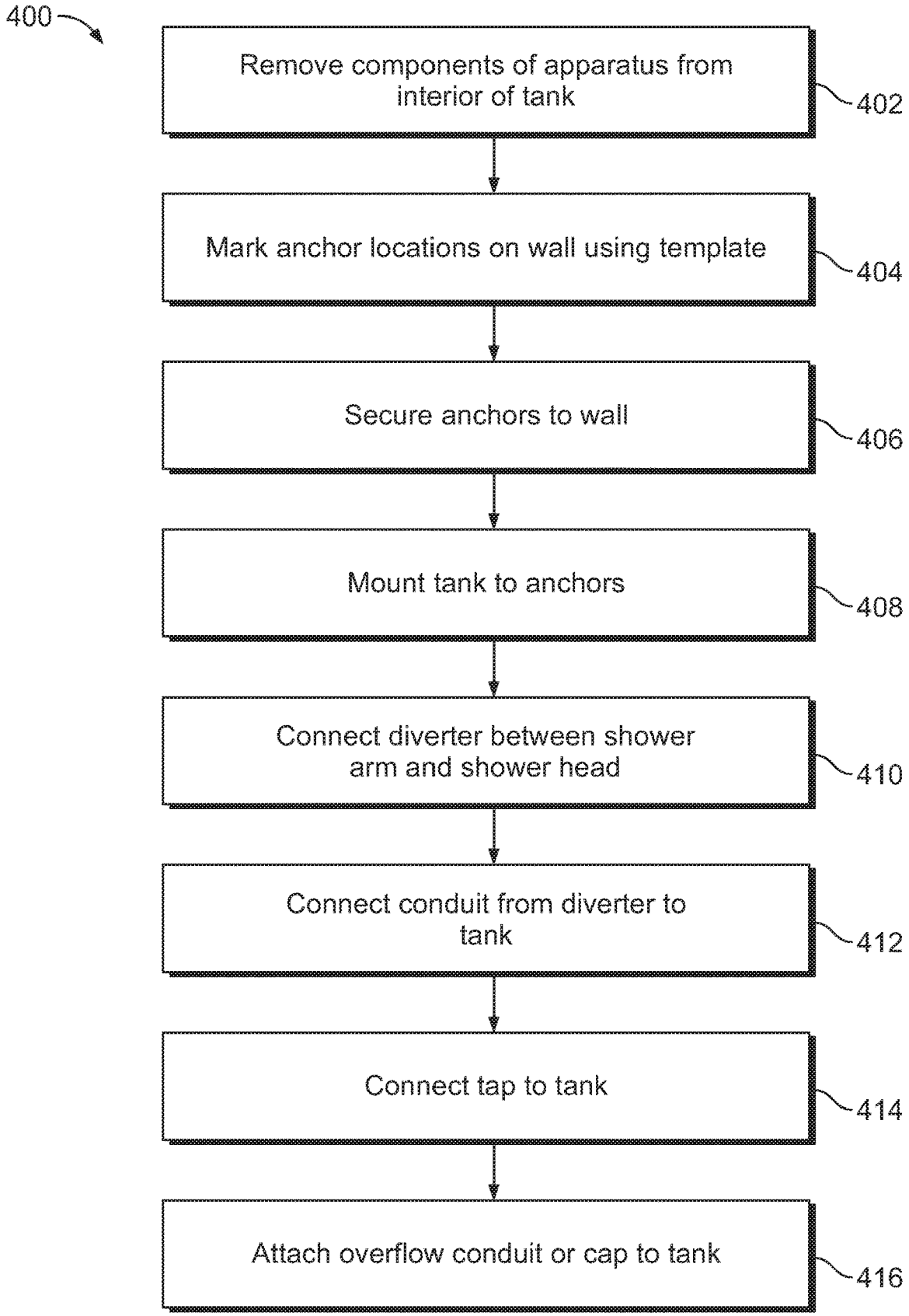
FIG. 10 is a flow chart of an example method for installing the water conservation apparatus of FIG. 1.

With reference to FIG. 10, a method 400 is provided for installing the water conservation apparatus 10. The operations of the method 400 are presented in a particular order, although the operations may be performed in a different order and various ones of the operations may be combined or separated as appropriate. In one embodiment, the water conservation apparatus 10 is provided as a kit 170 as discussed above with FIG. 3. The method 400 includes removing 402 the components of the apparatus 10 from the interior 172 of the tank 20.

The method 400 includes marking 404 the locations for the screws 178 on the wall 24 using the template 183. Regarding FIG. 3, the template 183 includes a body 185 having openings 187 formed therein. The openings 187 are positioned on the template 183 at distances apart and in alignment therewith that match the positioning of the pockets 240 on the rear wall 76 of the tank 20. The marking 404 may include using a marker, a pencil, and/or a sharp object, for example, to mark the position of the holes 187 on the wall 24. The template 183 is temporary and then may be removed by the user. Next, the method 400 includes securing 406 the anchors to the wall, such as by driving the screws 178 through the dry wall 280 and into the stud 80 (see FIG. 7).

The method 400 includes mounting 408 the tank 20 to the screws 178. The mounting 408 may include, with reference to FIG. 6, positioning the tank 20 so that each pocket 240 is vertically aligned with the corresponding screw 178 and lowering the tank 20 in direction 250 so that the heads 248 of the screws 178 enter the openings 260 of the pockets 240 and are received in the pockets 240 while the support portions 260 come to rest on the shanks 262 of the screws 178. The method 400 further includes connecting 410 the diverter valve assembly 28 between the shower arm 30 and the shower head 32. The connecting 410 may utilize the nylon tape 182 provided in the kit 170.

The method 400 further includes connecting 412 the reservoir supply conduit 36 from the diverter valve assembly 28 to the tank 20. The connecting 412 may include utilizing the threaded nipple 100, nut 110, and other components discussed above.

Next, the method 400 includes connecting 414 the tap 70 to the tank 20. The connecting 414 may include directly connecting the tap 70 to the tank 20 or may include utilizing the outlet conduit 152 (see FIG. 2) to connect the tap 70 to the tank 20. The outlet conduit 152 may be flexible and permit the installer to position the tap 70 at the desired location. In another embodiment, the method 400 may not include operation 414 such as if the tap 70 is preassembled with the tank 20.

The method 400 further includes attaching 416 an overflow conduit 132 or the cap 133 to the tank 20. In another embodiment, the method 400 may not include the operation 416, such as if the tank 20 does not include the overflow outlet opening 130 and instead is sealed so that it fills and does not overflow upon filling of the tank 20.

Figure 11:
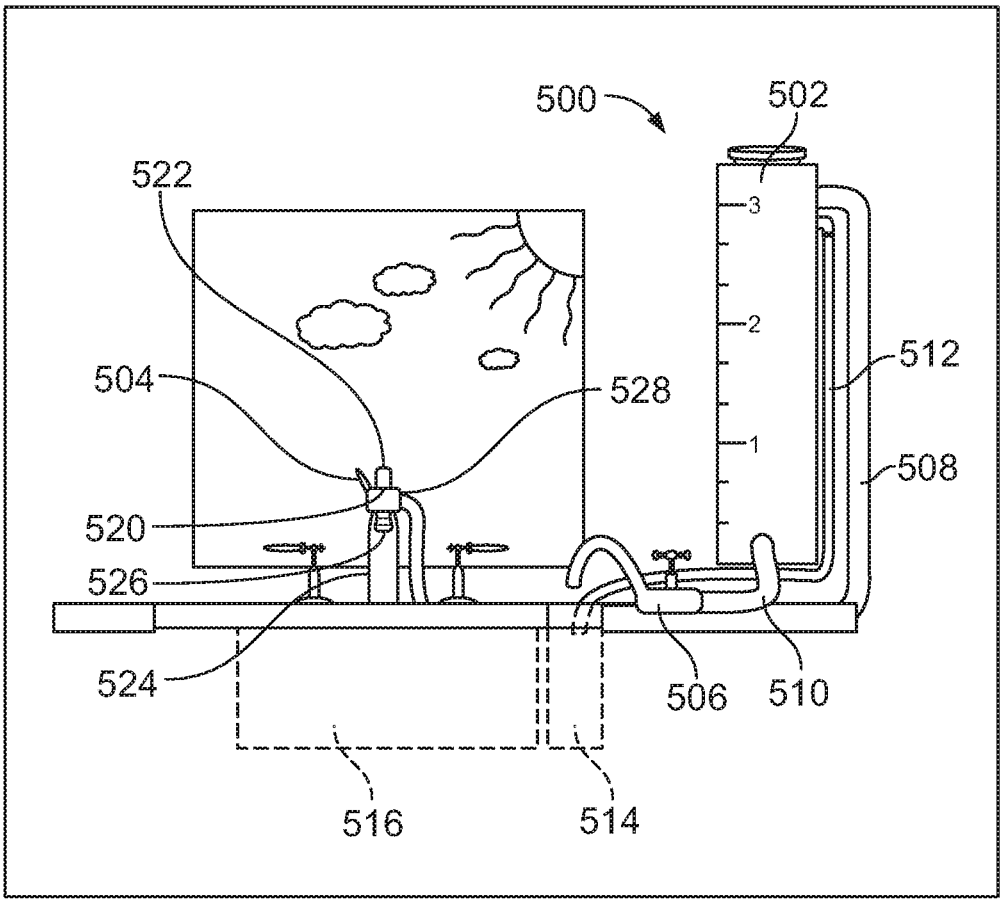
FIG. 11 is another water conservation apparatus configured to store wasted water from a faucet for subsequent use.

With reference to FIG. 11, a water conservation apparatus 500 is provided that is similar in many respects to the apparatus 10 discussed above such that differences between the two will be highlighted. The water conservation apparatus 500 includes a tank 502, a diverter valve assembly 504, and a tap 506. The apparatus 500 includes a tank supply conduit 508 connecting the diverter valve assembly 504 to the tank 502 and an outlet conduit 510 connecting the tank 502 to the tap 506. The apparatus 500 further includes an overflow conduit 512 configured to discharge overflow into a garbage disposal section 514 of a sink 516.

The diverter valve assembly 504 has an inlet 520 connected to an outlet 522 of a faucet 524. The diverter valve assembly 504 has a primary outlet 526 that discharges into the sink 516 and a secondary outlet 528 that discharges into the tank supply conduit 508. The diverter valve assembly 504 is different than the diverter valve assembly 28 discussed above in that the diverter valve assembly 504 is connected to the faucet 524 rather than the shower arm 30. In some embodiments, the diverter valve assembly 504 may be structurally the same as the diverter valve assembly 28 discussed above such that only the environment varies.

Figure 12:
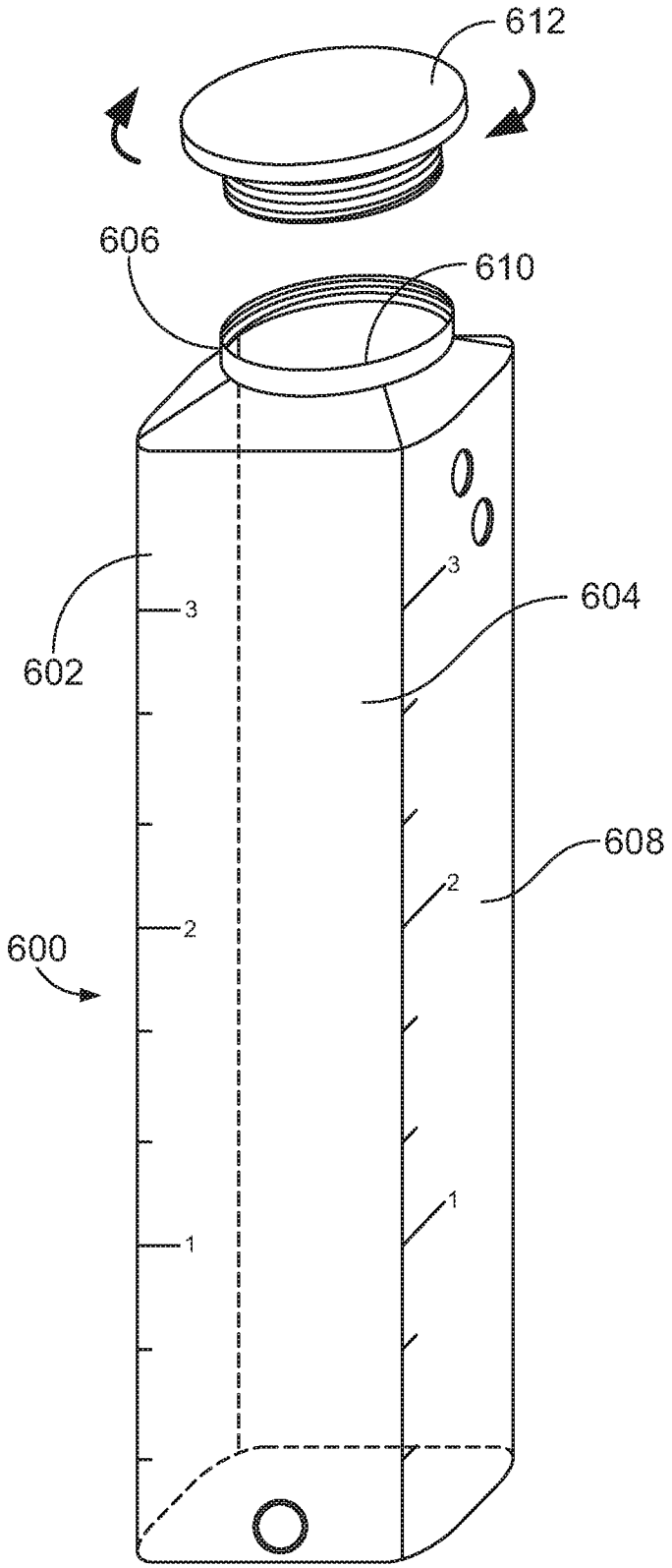
FIG. 12 is an elevational view of another tank that may be used with either of the systems of FIG. 1 and FIG. 11.

With reference to FIG. 12, a tank 600 is shown that is similar in many respects to the tank 20 discussed above. One difference between the tanks 20, 600 is that the tank 600 includes a rounded upper end portion 602 that connects side walls 604 to a neck 606 of the tank 600. The tank 600 includes a body 608 having an opening 610 that may be closed by a lid 612. The water conservation apparatus 10, 500 may be deployed with one tank 20, 502, 600, or additional tanks 20, 502, 600 to accommodate additional volumes of water. In one example, the water conservation apparatus 10 may include two tanks 20 that are connected to the diverter valve assembly 28 via a tank supply conduit 36 having a split that directs water into both tanks 20. The tanks 20 may include a conduit connecting the bottom of the tanks so that the water may drain from the tanks 20 together and one of the tanks may include the tap 70. The use of additional tanks provides additional storage capability for the water conservation system.

Figure 13:
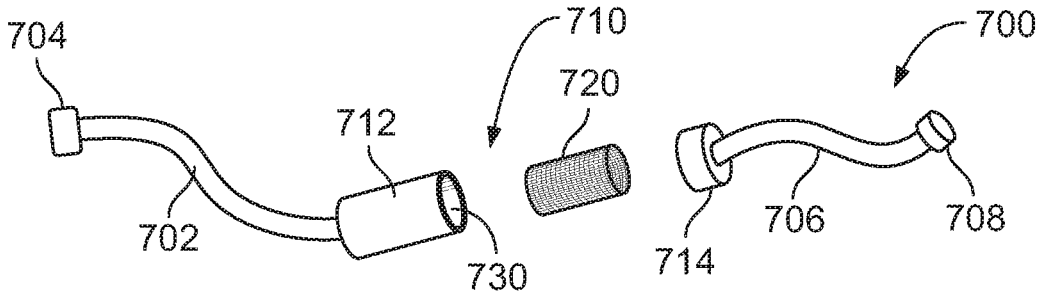
FIG. 13 is an exploded view of a reservoir supply conduit including an inline water filter.

With reference to FIG. 13, a conduit 700 is provided that may be used instead of or in addition to the tank supply conduit 36, 508 or outlet conduit 152, 510 discussed above. The conduit 700 includes a first conduit section 702 having a nut 704, a second conduit section 706 having a nut 708, and an inline filter 710. The filter 710 may include a housing portion 712 that is a portion of the first conduit section 702 and a housing portion 714 that is a portion of the second conduit section 706. The filter 710 may further include a filter cartridge 720. The filter cartridge 720 may be a charcoal-based cartridge, as one example. The housing portions 712, 714 may be configured to have a releasable connection therebetween that captures the filter cartridge 720 within a compartment 730 of the housing portion 712.

Figure 14:
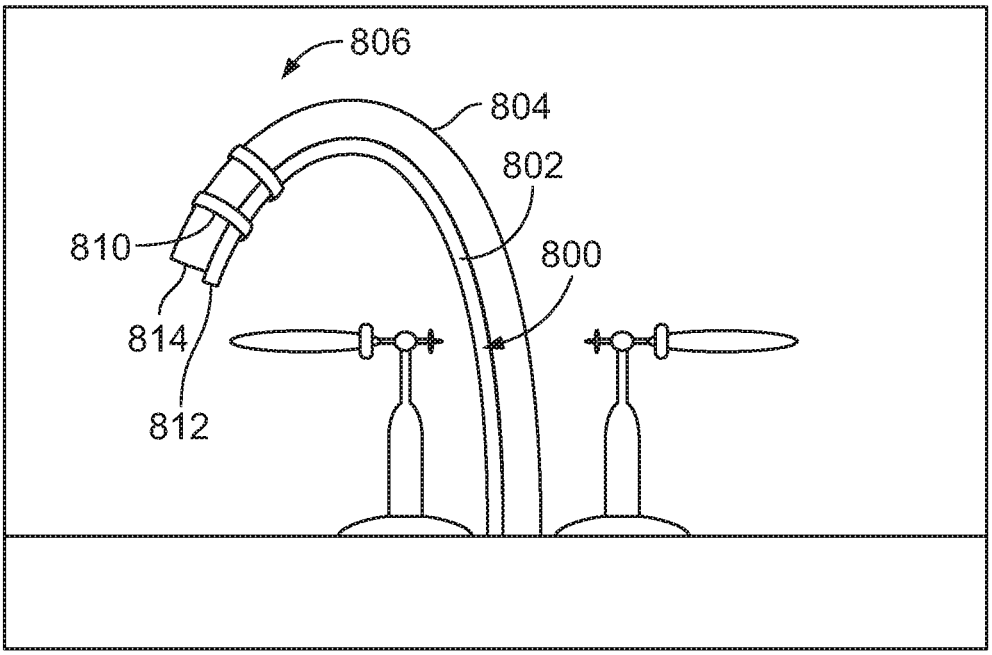
FIG. 14 is an elevational view of a tap connected to a faucet to discharge stored water in line with the path of water discharged from the faucet.

With reference to FIG. 14, another tap 800 is provided that may be used in place of or in addition to the taps 70, 506 discussed above. The tap 800 includes a conduit 802 that may be secured to a faucet 804 by a mount 806. In one embodiment, the mount 806 includes one or more securing members, such as ties 810. The ties 810 position an outlet 812 of the conduit 802 to discharge generally inline with an outlet opening 814 of the faucet 804.

While there have been illustrated and described particular embodiments of the present invention, it will be appreciated that numerous changes and modifications will occur to those skilled in the art, and it is intended for the present invention to cover all those changes and modifications which fall within the scope of the appended claims. It is intended that the phrase "at least one of" be interpreted in the disjunctive sense. For example, the phrase "at least one of A and B" is intended to encompass only A, only B, or both A and B.

What is claimed is:

1. A water conservation apparatus comprising:

a diverter having an inlet for being connected to a water supply, a primary outlet, and a secondary outlet;

a supply conduit configured to connect to the secondary outlet of the diverter;

an elongate water storage tank configured to connect to the supply conduit, the elongate water storage tank having an upper end portion and a lower end portion, the lower end portion including a bottom of the water storage tank;

the water storage tank including a body having an interior for receiving water from the secondary outlet of the diverter via the supply conduit, the upper end portion of the water tank including an opening of the body that opens to the interior;

the water storage tank including a lid configured to be connected to the body and close the opening;

the water storage tank having a height extending between the upper and lower end portions and a width perpendicular to the height that is less than the height so that the water from the secondary outlet of the diverter forms a column within the water storage tank;

a tap having an outlet and a valve, the valve having a closed position that inhibits water flow from the water storage tank to the outlet and an open position that permits water to be driven out of the outlet by the column of water in the water storage tank;

an overflow conduit to connect to the upper end portion of the water tank and permit excess water in the water storage tank to flow out of the water storage tank;

wherein the upper end portion of the water storage tank is configured to have the overflow conduit connected thereto at an overflow conduit height from the bottom of the water storage tank;

wherein the upper end portion of the water tank includes a side wall portion of the body having an opening therein at a supply conduit height from the bottom of the water storage tank;

wherein the supply conduit height and the overflow conduit height are both greater than half of the height of the water storage tank;

wherein the overflow conduit height is less than the supply conduit height;

at least one pocket of the water storage tank comprising:

a pocket opening sized to permit the pocket to be lowered onto an anchor so that a head of the anchor is received in the pocket;

a pair of side walls on opposite sides of the head of the anchor with the head of the anchor received in the pocket;

an outer wall connecting the side walls;

an arcuate support portion of the outer wall configured to rest on a shank of the anchor; and flange portions of the outer wall extending along opposite sides of the pocket opening on either side of the shank with the head received in the pocket, the flange portions configured to contact the shank of the anchor and inhibit lateral movement of the pocket relative to the anchor;

wherein the supply conduit includes a tube and an elbow fitting for connecting the tube to the upper end portion of the water storage tank, the elbow fitting having an outlet portion, an inlet portion, and an elbow portion connecting the outlet and inlet portions;

wherein the elbow fitting is sized to extend through the opening of the side wall portion of the body so that the outlet portion and the elbow portion of the elbow fitting are in the interior of the body and the inlet portion of the elbow fitting is outside of the body;

wherein the inlet portion of the elbow fitting is configured to have the tube of the supply conduit connected thereto;

wherein the elbow portion of the elbow fitting redirects water to the outlet portion of the elbow fitting; and wherein the outlet portion of the elbow fitting directs water toward the lower end portion of the water tank.

2. The water conservation apparatus of claim 1 wherein the inlet of the diverter is configured to be connected to a shower arm and the primary outlet of the diverter is configured to be connected to a shower head.

3. The water conservation apparatus of claim 1 wherein the body is made of a transparent material.

4. The water conservation apparatus of claim 1 wherein the at least one pocket of the water storage tank includes a plurality of pockets aligned along the height of the water storage tank.

5. The water conservation apparatus of claim 1 in combination with the anchor having the head and the shank.

6. The water conservation apparatus of claim 1 wherein the diverter includes a handle movable from a first position wherein the diverter directs water from the inlet to the primary outlet to a second position wherein the diverter directs water from the inlet to the secondary outlet.

7. The water conservation apparatus of claim 1 wherein the diverter inlet is configured to be releasably connected to the water supply.

8. A water conservation apparatus comprising:

a diverter having an inlet, a primary outlet, and a secondary outlet;

a water tank having an upper end portion and a lower end portion, the lower end portion including a bottom of the water tank;

a supply conduit configured to connect the upper end portion of the water tank to the secondary outlet of the diverter, the supply conduit including a tube and an elbow fitting;

the elbow fitting having an outlet portion, an inlet portion, and an elbow portion connecting the outlet and inlet portions;

the water tank including a body having an interior for receiving water from the secondary outlet of the diverter via the supply conduit, the upper end portion of the water tank including an opening of the body that opens to the interior;

the water tank including a lid configured to be connected to the body and close the opening;

a tap associated with the lower end portion of the water tank and having an open configuration that permits water in the water tank to flow out from the tap and a closed configuration that retains water in the water tank;

an overflow conduit to connect to the upper end portion of the water tank and permit excess water to flow out of the water tank;

the water tank having a height extending between the upper and lower end portions;

the upper end portion of the water storage tank is configured to have the supply conduit connected thereto at a supply conduit height from the bottom of the water storage tank, the upper end portion of the water storage tank including a side wall portion of the body having an opening;

wherein the elbow fitting is sized to extend through the opening of the side wall portion of the body so that the outlet portion and the elbow portion of the elbow fitting are in the interior of the body and the inlet portion of the elbow fitting is outside of the body;

wherein the inlet portion of the elbow fitting is configured to have the tube of the supply conduit connected thereto;

wherein the elbow portion of the elbow fitting redirects water to the outlet portion of the elbow fitting;

wherein the outlet portion of the elbow fitting directs water toward the lower end portion of the water tank;

at least one pocket of the water storage tank comprising:

a pocket opening sized to permit the pocket to be lowered onto an anchor so that a head of the anchor is received in the pocket;

a pair of side walls on opposite sides of the head of the anchor with the head of the anchor received in the pocket;

an outer wall connecting the side walls;

an arcuate support portion of the outer wall configured to rest on a shank of the anchor; and flange portions of the outer wall extending along opposite sides of the pocket opening on either side of the shank with the head received in the pocket, the flange portions configured to contact the shank of the anchor and inhibit lateral movement of the pocket relative to the anchor;

the upper end portion of the water tank is configured to have the overflow conduit connected thereto at an overflow conduit height from the bottom of the water tank;

wherein the supply conduit height and the overflow conduit height are both greater than half of the height of the water storage tank; and wherein the overflow conduit height is less than the supply conduit height so that the overflow conduit permits excess water in the supply conduit to flow into the water tank and out of the tank via the overflow conduit once the secondary outlet of the diverter stops providing water to the supply conduit.

9. The water conservation apparatus of claim 8 wherein the overflow conduit height is sized to permit the water tank to fill with at least 1.5 gallons of water before water flows out of the water tank.

10. The water conservation apparatus of claim 8 further comprising:

a cap configured to close the opening of the side wall portion of the body.

11. The water conservation apparatus of claim 8 wherein the supply conduit and the overflow conduit connect to the water tank at locations that are horizontally offset from one another.

12. The water conservation apparatus of claim 8 wherein the overflow conduit includes a connector that extends through the opening of the side wall portion of the body of the water tank and an elongate tube having a first end connected to the connector and an opposite second end having an outlet opening.

13. The water conservation apparatus of claim 8 wherein the inlet of the diverter is configured to be connected to a shower arm and the primary outlet of the diverter is configured to be connected to a shower head.

14. The water conservation apparatus of claim 1 wherein the elbow portion of the elbow includes a ninety degree bend.

15. The water conservation apparatus of claim 1 wherein the water storage tank has a depth extending perpendicular to the height and the width; and wherein the width and depth of the water storage tank are each less than one quarter of the height.

16. The water conservation apparatus of claim 1 further comprising an outlet conduit configured to connect the tap to the water storage tank; and wherein at least one of the supply conduit, outlet conduit, and water tank includes a filter.

17. A water conservation apparatus comprising:

a plurality of anchors each having a head and a shank, the anchors configured to be secured to a wall;

a diverter having an inlet, a primary outlet, and a secondary outlet;

a water tank body having an upper end portion, a lower end portion, and a height;

the upper end portion including an opening and the lower end portion including a bottom wall;

a supply conduit configured to connect the water tank body to the secondary outlet of the diverter, the supply conduit including a tube and an elbow fitting;

the elbow fitting having an outlet portion, an inlet portion, and an elbow portion connecting the outlet and inlet portions;

an overflow conduit to connect to the upper end portion of the water tank body and permit excess water to flow out of the water tank;

wherein the upper end portion of the water tank body is configured to have the overflow conduit connected thereto at an overflow conduit height from the bottom wall of the water tank body;

a tap having an outlet and a valve, the valve having a closed position that inhibits water flow from the water tank to the outlet and an open position that permits water to be driven out of the outlet by the water in the tank;

a side wall portion of the upper end portion of the water tank body, the side wall portion having an opening therein at a supply conduit height from the bottom wall of the water tank body;

wherein the elbow fitting is sized to extend through the opening of the side wall portion of the water tank body so that the outlet portion and the elbow portion of the elbow fitting are in the interior of the water tank body and the inlet portion of the elbow fitting is outside of the water tank body;

wherein the inlet portion of the elbow fitting is configured to have the tube of the supply conduit connected thereto;

wherein the elbow portion of the elbow fitting redirects water to the outlet portion of the elbow fitting;

wherein the outlet portion of the elbow fitting directs water toward the lower end portion of the water tank body;

wherein the supply conduit height and the overflow conduit height are both greater than half of the height of the water tank body;

wherein the overflow conduit height is less than the supply conduit height;

a rear wall portion of the water tank body extending between the upper and lower end portions of the water tank body;

a plurality of pockets of the rear wall portion of the water tank body, each pocket comprising:

a pocket opening sized to permit the pocket to be lowered onto one of the anchors so that the head of the one anchor is received in the pocket;

a pair of side walls on opposite sides of the head of the one anchor with the head of the one anchor received in the pocket;

an outer wall connecting the side walls;

an arcuate support portion of the outer wall configured to rest on the shank of the one anchor;

flange portions of the outer wall extending along opposite sides of the pocket opening on either side of the shank with the head received in the pocket, the flange portions configured to contact the shank of the one anchor and inhibit lateral movement of the pocket relative to the one anchor; and the plurality of pockets configured to facilitate mounting of the water tank body in a downward movement onto the anchors to connect the water tank body to the anchors once the anchors have been secured to the wall and, upon the water tank body being connected to the anchors, to limit movement of the water tank body relative to the anchors to an upward movement off of the anchors to disconnect the water body tank from the anchors.

18. The water conservation apparatus of claim 17 wherein the arcuate support portion includes an arcuate edge to contact an upper surface portion of the shank of the one anchor and the flange portions include straight edges to contact opposite side portions of the shank of the one anchor.

19. The water conservation apparatus of claim 17 wherein the water tank body, including the rear wall portion and the pockets, has a unitary, one-piece construction.

20. The water conservation apparatus of claim 17 wherein at least a portion of the water tank body is transparent.

* * * * *